US007320234B2

(12) United States Patent
Hershey et al.

(10) Patent No.: US 7,320,234 B2
(45) Date of Patent: Jan. 22, 2008

(54) SYSTEM AND METHOD FOR A COMBINED LAUNDRY WASHER AND DRYER

(76) Inventors: John P. Hershey, R.R. 16 Box 440 C, Edinburg, TX (US) 78539; Leticia Hershey, R.R. 16 Box 440 C, Edinburg, TX (US) 78539

( * ) Notice: Subject to any disclaimer, the term of this patent is extended or adjusted under 35 U.S.C. 154(b) by 12 days.

(21) Appl. No.: 11/338,250

(22) Filed: Jan. 24, 2006

(65) Prior Publication Data

US 2007/0169519 A1 Jul. 26, 2007

(51) Int. Cl.
*D06F 39/04* (2006.01)

(52) U.S. Cl. ..... 68/19.1; 68/20

(58) Field of Classification Search ..... 68/19.1, 68/20

See application file for complete search history.

(56) References Cited

U.S. PATENT DOCUMENTS 2,165,487 A * 7/1939 Johnson ..... 68/18 C
2,816,429 A * 12/1957 Kurlancheek ..... 68/19.2
2,834,121 A * 5/1958 Geldhof ..... 34/75
2,866,273 A * 12/1958 Geldhof ..... 34/75
3,555,701 A * 1/1971 Hubbard ..... 34/602
3,805,404 A * 4/1974 Gould ..... 34/75
6,006,445 A 12/1999 Large
6,012,306 A 1/2000 Raes
6,671,978 B1 1/2004 McGowan et al.

FOREIGN PATENT DOCUMENTS

DE 2 450 024 * 4/1975

* cited by examiner

*Primary Examiner*—Frankie L. Stinson
(74) *Attorney, Agent, or Firm*—Raymond M. Galasso; Galasso & Associates LP

(57) ABSTRACT

A combined laundry washer and dryer system is provided so that the user can wash a first load of laundry, start drying the first load, and wash a second load while the first load is drying. The system comprises a front-loadable washer on top of a dryer, and a second load compartment on top of the washer. A load of laundry is placed in the washer and a second load in the second load compartment. After washing the first load, the washer drops it into the dryer for drying. The second load compartment then drops the second load into the washer for washing. A side-mounted closet may be used to steam clean, dried laundry with air from the dryer. Conveyor belts may be used to move dirty laundry into the second load compartment and clean laundry from the dryer to a sorting area.

18 Claims, 3 Drawing Sheets

SYSTEM AND METHOD FOR A COMBINED LAUNDRY WASHER AND DRYER

FIELD OF THE DISCLOSURE

The present invention relates to laundry washers and dryers and more particularly to combined washer and dryer systems.

BACKGROUND

Laundry washers and dryers are common labor-saving devices in many homes and businesses. However, washing and drying a single load of laundry typically requires two separate processes. First, the laundry is manually placed in a washer, automatically washed, and manually removed from the washer, and then the laundry is manually placed in a dryer and automatically dried. Because this procedure is labor intensive, combined laundry washer and drier systems have been provided to simplify it.

For example, U.S. Pat. No. 6,671,978 to McGowan provides a combined washer and dryer, which automatically moves laundry from the washer to the dryer by means of an automatic load-feeder, so that the user does not have to manually move the wet laundry to the dryer.

U.S. Pat. No. 6,012,306 to Raes provides a combined washing and drying machine "wherein the washing and drying means are mounted within a pivoting subassembly." After the laundry has been washed vertically in a basket, the pivoting assembly moves to tumble dry the laundry horizontally in the basket.

U.S. Pat. No. 6,006,445 to Larger provides a combined washing and drying machine with a system of air ducts for drying the laundry.

Although these systems allow the user to employ one machine to wash and dry laundry, they only one load of laundry may be washed during a cycle of washing and drying. Until the laundry has been removed, a second load of laundry cannot be washed. Thus, a user with multiple loads of laundry to be washed and dried has to wait during drying times before washing addition loads.

Therefore, there is a need for a combined washer and drier configured so that the user can wash a first load of laundry, start drying the first load, and wash a second load while the first load is drying.

SUMMARY OF THE DISCLOSURE

The following explanation describes the present invention by way of example and not by way of limitation.

It is an aspect of the present invention to provide a combined laundry washer and dryer.

It is another aspect of the present invention to a combined laundry washer and dryer configured so that the user can wash a first load of laundry, start drying the first load, and wash a second load while the first load is drying.

These and other aspects of the present invention will become readily apparent upon further review of the following specification and associated drawings. In accordance with the present invention, a combined laundry washer and dryer system is provided so that the user can wash a first load of laundry, start drying the first load, and wash a second load while the first load is drying. The system comprises a front-loadable washer on top of a dryer, and a second load compartment on top of the washer. A load of laundry is placed in the washer and a second load in the second load compartment. After washing the first load, the washer drops it into the dryer for drying. The second load compartment then drops the second load into the washer for washing. A side-mounted closet may be used to steam clean, dried laundry with air from the dryer. Conveyor belts may be used to move dirty laundry into the second load compartment and clean laundry from the dryer to a sorting area.

BRIEF DESCRIPTION OF THE DRAWINGS

The following embodiments of the present invention are described by way of example only, with reference to the accompanying drawings, in which.

DETAILED DESCRIPTION OF THE DRAWING FIGURES

The following description of drawings is offered to illustrate the present invention clearly. However, it will be apparent to those skilled in the art that the concepts of the present invention are not limited to these specific details. Also, commonly known elements are shown in diagrams for clarity, as examples only and not as limitations of the present invention.

The Continuous Washer and Dryer System

Figure 1:
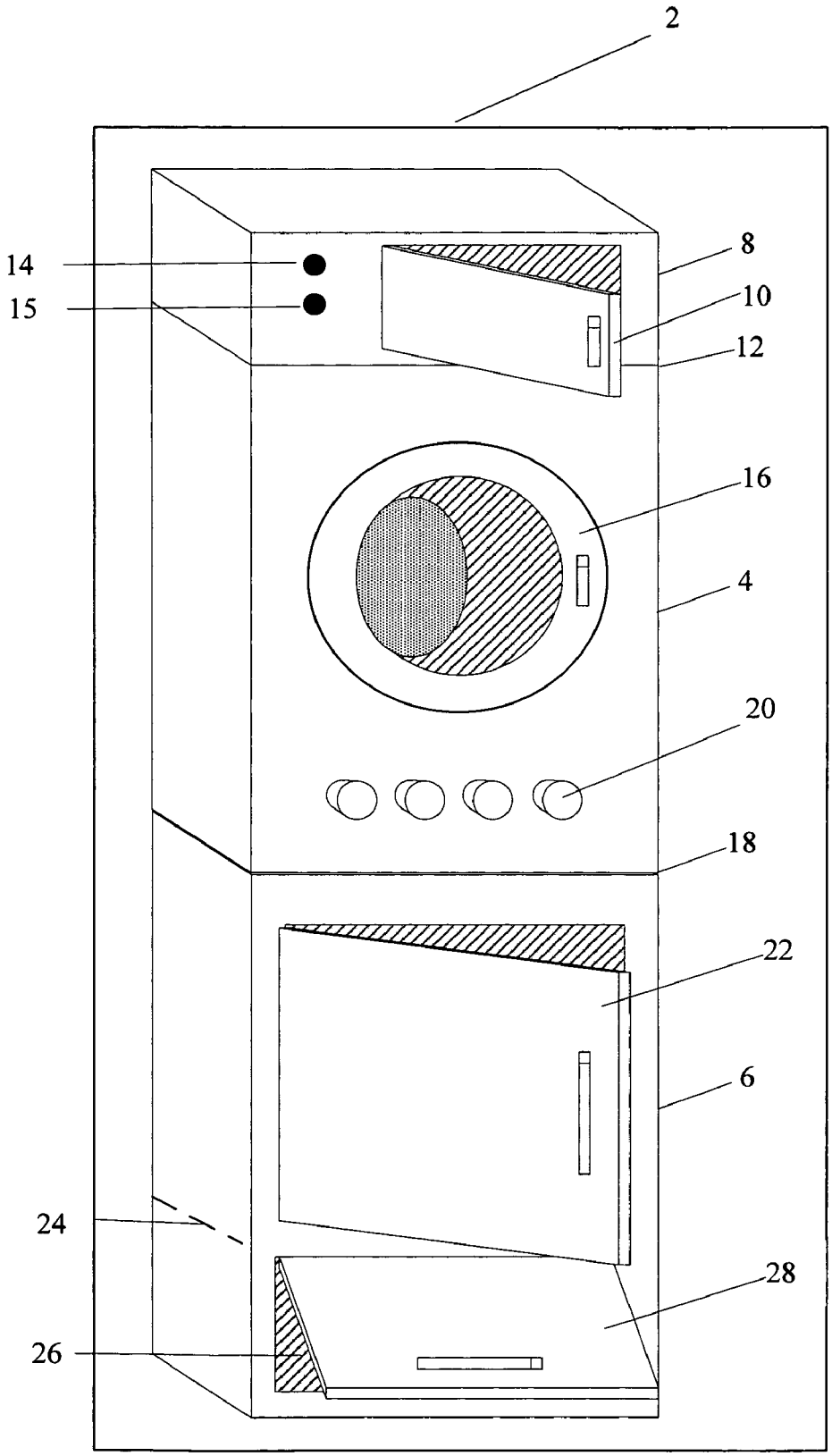
FIG. 1 is a perspective diagram that illustrates a combined laundry washer and dryer system.

The present invention comprises a continuous washer and dryer system 2, shown in FIG. 1, with a front-loadable washer 4 on top and a dryer 6 on bottom. Unlike prior washer and dryer sets, the continuous washer and dryer system 2 allows a second load of laundry to be washed while a first load is drying.

The continuous washer and dryer system 2 is built with a second load compartment 8 on top of the washer 4 that has the capacity for an average load of laundry and is set to dispense the load automatically into the washer 4 when ready. A standard front door 10 on the second load compartment 8 can be opened so that the user can add laundry to the second load compartment 8. A magnet-operated, spring-loaded trap door 12 in the bottom of the second load compartment 8 allows laundry to fall into the washer 4. After the laundry has passed through the magnet-operated, spring-loaded door 12, the spring on the door 12 closes the door 12 upward. Two detergent fill holes, one 14 for dry detergent and one 15 for liquid, are located on the second load compartment 8 in an embodiment, and lead to storage areas with access the washer 4.

In an embodiment, the washer 4 comprises a front door 16 that users cam employ to add laundry directly into the washer 4, and if necessary, to remove laundry from the washer 4. The washer 4 further comprises a drainage plate and a magnet-operated, spring-loaded trap door 18 in the bottom of the washer 4*s*. The drainage plate is molded with drainage holes so that water can drain from the washer 4 and be diverted through a hose. The trap door 18 allows laundry to fall into the dryer 6. After the laundry has passed through the trap door 18, the spring on the door 18 closes the door 18 upward. Controls 20 on the washer 4 allow the user to control the operation of the continuous washer and dryer system 2.

The dryer 6 comprises front door 22 that allows users to remove laundry from the dryer 6, and, if necessary, to add laundry to the dryer 6 manually. Another magnet-operated, spring-loaded trap door 24, located in the bottom of the dryer 6, allows laundry to fall through a chute 26 and out a hinged, spring-loaded door 28 in the lower front of the dryer 6, for example into a waiting basket. After the laundry has passed through the door 24, the spring on the door 24 closes the door 24 upward. In the same way, the spring on the door 28 in the lower front of the dryer 6 closes the door 28 after the laundry has passed through the door 28.

Figure 2:
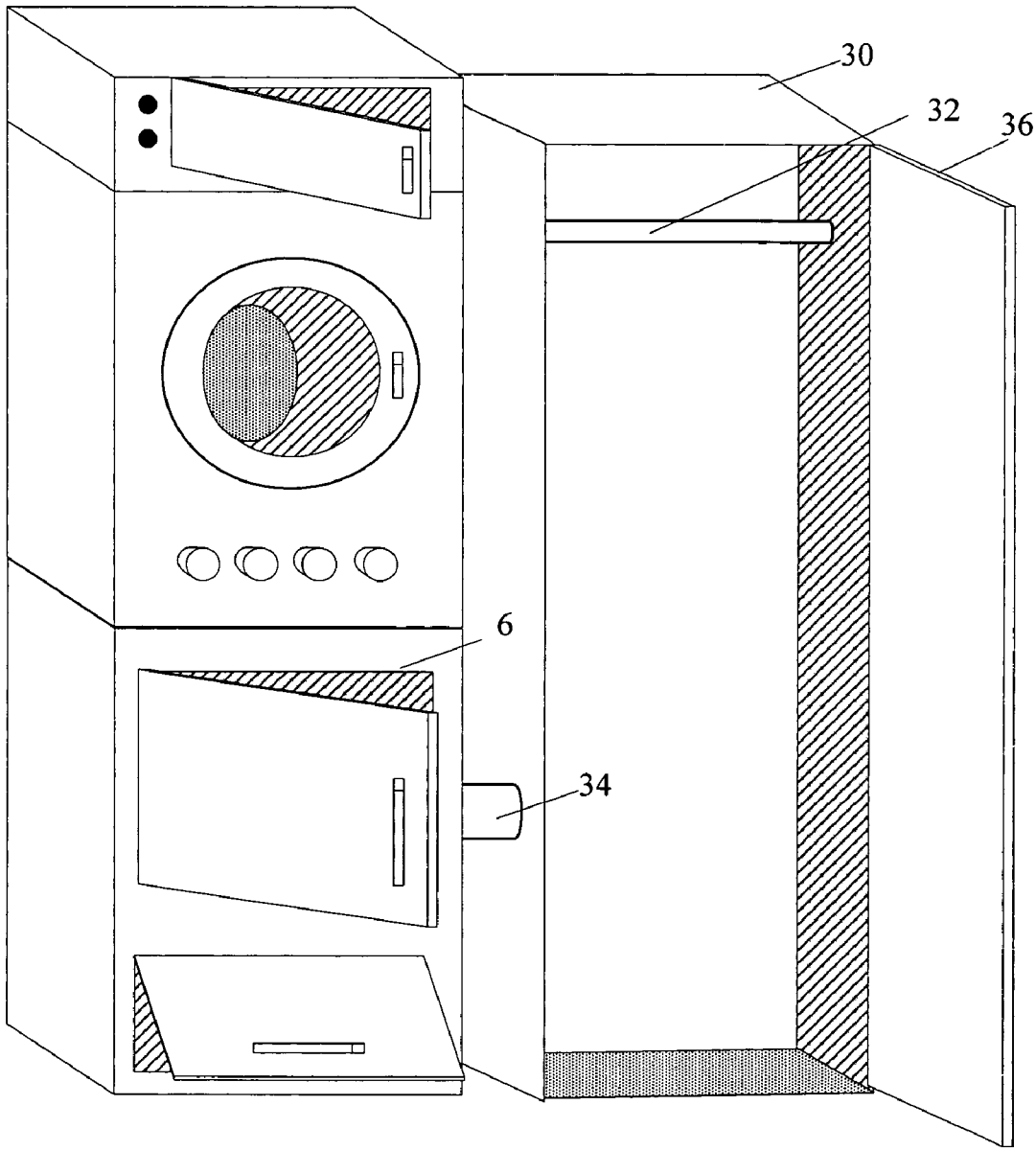
FIG. 2 is a perspective diagram that illustrates a combined laundry washer and dryer system with a side-mounted closet.

An embodiment, shown in FIG. 2, comprises a side-mounted closet 30 where clothes can be placed or hung after drying, for example on a bar 32. Hot, moist air from the dryer 6 is vented through specially placed hot air vents 34 into the closet 30 to steam the laundry to reduce or remove wrinkles. A standard door 36 allows the user to open and close the side-mounted closet 30.

Figure 3:
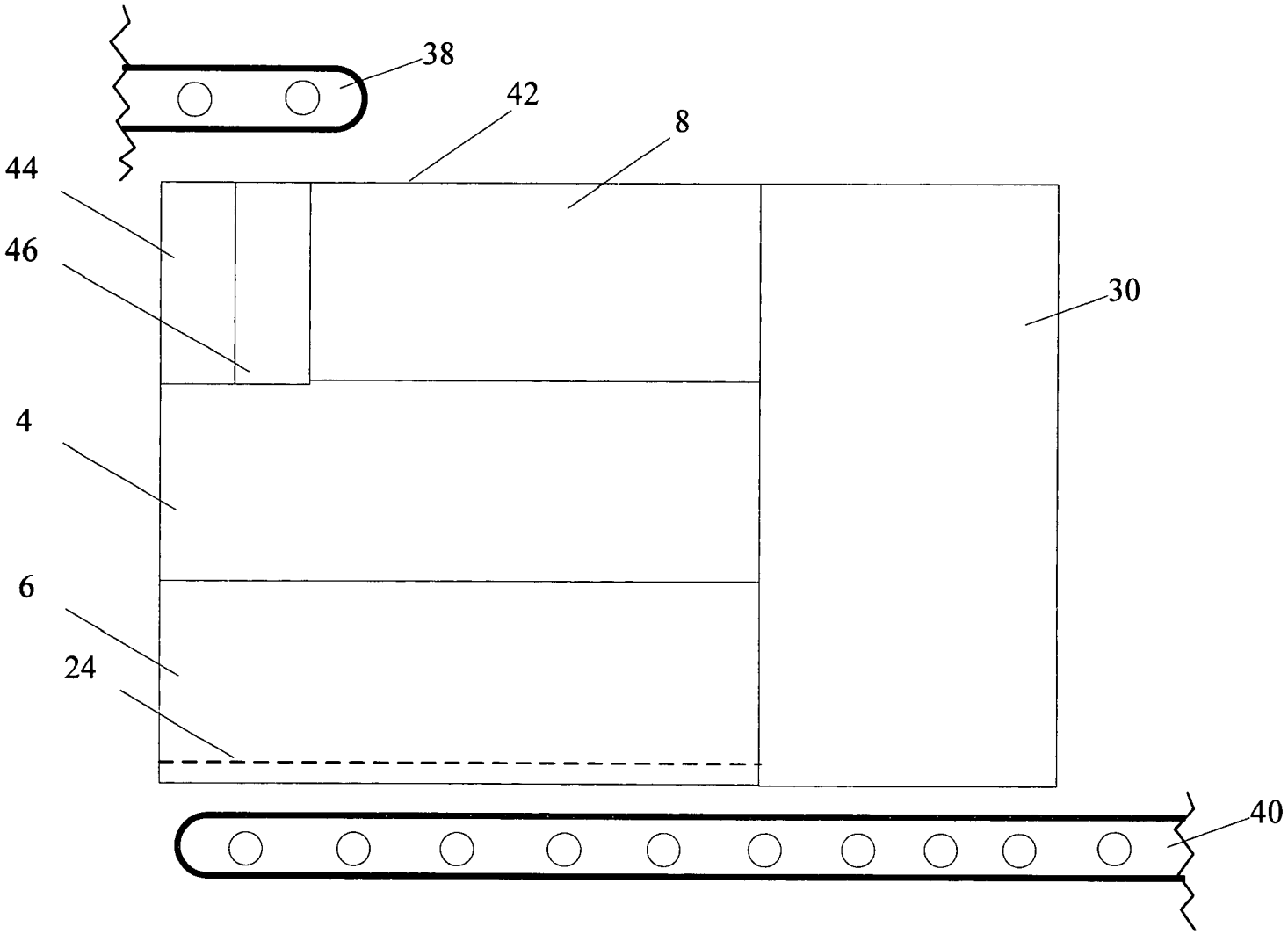
FIG. 3 is a perspective diagram that illustrates a combined laundry washer and dryer system with conveyor belts.

Another embodiment, shown in FIG. 3, comprises a top conveyor belt 38 and a bottom conveyor belt 40. The top conveyor belt 38 is used to carry laundry to the top of the second load compartment 8. After moving off the edge of the top conveyor belt 38, the laundry falls against a hinged, spring-loaded trap door 42 on the top of the second load compartment 8. The force of the falling laundry opens the hinged, spring-loaded trap door 42, which allows the laundry to fall into the second load compartment 8. After the laundry has passed through the hinged, spring-loaded door 42, the spring on the door 42 closes the door 42 upward. A container area 44 in the second load compartment 8 is used to contain laundry detergent, and another container area 46 in the second load compartment 8 is used to contain laundry softener.

After the laundry is moved from the second load compartment 8 to the washer 4 and then to the dryer 6 to be washed and dried, it drops through the trap door 24 in the bottom of the dryer 6, as described above, and onto the bottom conveyor belt 40. The bottom conveyor belt 40 then carries the cleaned and dried laundry to another area, which in different embodiments may either comprise the side-mounted steam closet 30 or an area in another location, for example a sorting area. This embodiment would greatly reduce the labor hours for laundry services that wash and dry large amounts of laundry on a daily basis, for example for uniform companies or hotel chains.

In an embodiment, the continuous washer and dryer set 2, shown in FIG. 1, is manufactured of stainless steel, high density and low density plastics, and electrical wiring and circuits. These materials are used to make components similar to those in other stackable washer and dryer sets, comprising, for example, suspension rods, springs, an agitator assembly, hoses, belts, simple controls, and other assorted parts, as is known to those skilled in the art. The side-mounted closet 30, shown in FIG. 2, may also be manufactured of stainless steel. In an embodiment, the drainage plate is manufactured of plastic.

The best dimensional relationships for the parts of the invention described above, including variations in form and use, will be readily apparent to those skilled in the art, and are intended to be encompassed by the present invention. An embodiment measures 60 inches in height, 27.5 inches in length, and 27 inches in depth. An industrial-sized embodiment measures 6 feet in height, 4.5 feet in width, and 3 feet in depth. An industrial-sized embodiment with a side mounted closet measures 6 feet in height, 6 feet in width, and 3 feet in depth.

Use

To employ the continuous washer and dryer system shown in FIG. 1, a user typically opens the door 16 on the washer 4 and places a first load of laundry into the washer 4. According to the type of washing desired, the user adds dry laundry detergent to the dry detergent dispenser 14, or liquid laundry detergent to the liquid detergent dispenser 15, and operates the controls 20 to control the type of washing and drying and to start the washing. If desired, the user then opens the door 10 in the second load compartment 8 and adds a second load of laundry there.

After the washer 4 completes its washing cycle for the first load of laundry and the drainage plate drains the water, the trap door 18 in the bottom of the washer 4 automatically opens, so that the washed laundry drops into the dryer 6. The spring in the trap door 18 automatically closes the door 18 again, and the dryer 6 starts to dry the first load of laundry. The trap door 12 in the bottom of the second load compartment 8 then automatically opens to drop the second load of laundry into the washer 6, and the door 12 is closed by its spring. The washer 6 then starts washing the second load of laundry. At the end of each dry cycle the magnet—released trap door 24 in the bottom of the dryer 6 automatically opens to drop the clean, dry clothes out of the front of the dryer 6 through a chute 26 and door 28, for example into a laundry basket. Successive loads of laundry may be added to the second load compartment 8 continuously.

With the embodiment shown in FIG. 2, the user may open the door 36 and manually place clean, dried laundry into the side-mounted closet 30, for example by hanging the laundry on the bar 32. When the dryer 6 is in use, hot, moist air from the dryer 6 is vented through the hot air vents 34 into the closet 30 to steam the laundry to reduce or remove wrinkles.

To employ the embodiment shown in FIG. 3, the user places laundry on the top conveyor belt 38, which carries the laundry to the top of the second load compartment 8, as mentioned above. After moving off the edge of the top conveyor belt 38, the laundry falls against a hinged door 42 on the top of the second load compartment 8. The force of the falling laundry opens the hinged door 42, which allows the laundry to fall into the second load compartment 8. A container area 44 in the second load compartment 8 contains laundry detergent, and another container area 46 in the second load compartment 8 contains laundry softener. After the laundry is moved from the second load compartment 8 to the washer 4 and then to the dryer 6, being washed and dried as described above, it drops through the trap door 24 in the bottom of the dryer 6 and onto the bottom conveyor belt 40. The bottom conveyor belt 40 then carries the cleaned and dried laundry to another area, where the user can retrieve the laundry. Additional loads of laundry can be moved on the top conveyor belt 38 and into the second load compartment 8 each time the washer 4 completes a wash cycle.

The present invention thus provides an assembly line, with several embodiments, for continuously washing and drying multiple loads of laundry simultaneously.

What is claimed is:

1. A combined laundry washer and dryer system, such that the user can wash a first load of laundry, start drying the first load, and wash a second load while the first load is drying, the combined laundry washer and dryer system comprising a laundry washer, comprising a drainage plate; and a magnet-operated, spring-loaded trap door with access to a laundry dryer beneath the washer;

a laundry dryer mounted beneath the laundry washer;

a second load compartment mounted on top of the laundry washer, the second load compartment comprising a magnet-operated, spring-loaded trap door in the bottom of the second load compartment and with access to the washer;

means of loading laundry into the washer;

means of loading laundry detergents and softeners into the washer; wherein the means of loading laundry detergents and softeners into the washer comprises at least one fill hole for detergent mounted on the second load compartment and leading to a container area with machine-controlled access to the washer; and at least one fill hole for softener mounted on the second load compartment leading to a container area with machine-controlled access to the washer;

means of removing laundry from the dryer; and means of loading laundry into the second load compartment; and controls.

2. The laundry washer of claim 1, wherein the laundry washer further comprises a front-loadable washer.

3. The means of loading laundry into the washer of claim 1, wherein the means of loading laundry into the washer comprises a front door on the washer.

4. The means of loading laundry into the washer of claim 1, wherein the means of loading laundry into the washer comprises the magnet-operated, spring-loaded trap door in the bottom of the second load compartment.

5. The means of removing laundry from the dryer of claim 1, wherein the means of removing laundry from the dryer comprises a front door on the dryer.

6. The means of removing laundry from the dryer of claim 1, wherein the means of removing laundry from the dryer comprises a magnet-operated, spring-loaded trap door on the bottom of the dryer;

a chute underneath the trap door on the bottom of the dryer; and a hinged, spring-loaded front door opening from the chute.

7. The means of removing laundry from the dryer of claim 1, wherein the means of removing laundry from the dryer comprises a magnet-operated, spring-loaded trap door on the bottom of the dryer; and a conveyor belt underneath the magnet-operated, spring-loaded trap door on the bottom of the dryer, such that the conveyor belt moves the laundry to a desired location.

8. The means of loading laundry into the second load compartment of claim 1, wherein the means of loading laundry into the second load compartment comprises a front door on the second load compartment.

9. The means of loading laundry into the second load compartment of claim 1, wherein the means of loading laundry into the second load compartment comprises a hinged, spring loaded trap door on the top of the second load compartment; and a conveyor belt, such that the conveyor belt deposits laundry on the hinged, spring-loaded trap door on top of the second load compartment.

10. The combined laundry washer and dryer system of claim 1, wherein the combined laundry washer and dryer system further comprises a side-mounted closet, such that the side-mounted closet steams laundry placed inside it, the side-mounted closet comprising at least one hot air vent that extends from the dryer of the combined washer and dryer system into the side-mounted closet; and a door.

11. A combined laundry washer and dryer system, such that the user can wash a first load of laundry, start drying the first load, and wash a second load while the first load is drying, the combined laundry washer and dryer system comprising a front-loadable laundry washer, comprising a front door;

a drainage plate in the bottom of the laundry washer; and a magnet-operated, spring-loaded trap door in the bottom of the laundry washer and with access to a laundry dryer beneath the washer;

a laundry dryer mounted beneath the laundry washer;

a second load compartment mounted on top of the laundry washer, the second load compartment comprising a magnet-operated, spring-loaded trap door in the bottom of the second load compartment and with access to the washer;

means of loading laundry detergents and softeners into the washer; wherein the means of loadina laundry detergents and softeners into the washer comprises at least one fill hole for detergent mounted on the second load compartment and leading to a container area with machine-controlled access to the washer; and at least one fill hole for softener mounted on the second load compartment leading to a container area with machine-controlled access to the washer;

means of removing laundry from the dryer;

means of loading laundry into the second load compartment; controls; and a side-mounted closet, such that the side-mounted closet steams laundry placed inside it, the side-mounted closet comprising at least one hot air vent that extends from the dryer of the combined washer and dryer system into the side-mounted closet; and a door.

12. The means of removing laundry from the dryer of claim 11, wherein the means of removing laundry from the dryer comprises a front door on the dryer.

13. The means of removing laundry from the dryer of claim 11, wherein the means of removing laundry from the dryer comprises a magnet-operated, spring-loaded trap door on the bottom of the dryer;

a chute underneath the trap door on the bottom of the dryer; and a hinged, spring-loaded front door opening from the chute.

14. The means of removing laundry from the dryer of claim 11, wherein the means of removing laundry from the dryer comprises a magnet-operated, spring-loaded trap door on the bottom of the dryer; and a conveyor belt underneath the magnet-operated, spring-loaded trap door on the bottom of the dryer, such that the conveyor belt moves the laundry to a desired location.

15. The means of loading laundry into the second load compartment of claim 11, wherein the means of loading laundry into the second load compartment comprises a front door on the second load compartment.

16. The means of loading laundry into the second load compartment of claim 11, wherein the means of loading laundry into the second load compartment comprises a hinged, spring loaded trap door on the top of the second load compartment; and a conveyor belt, such that the conveyor belt deposits laundry on the hinged, spring-loaded trap door on top of the second load compartment.

17. A combined laundry washer and dryer system, such that the user can wash a first load of laundry, start drying the first load, and wash a second load while the first load is drying, the combined laundry washer and dryer system comprising a laundry washer, the laundry washer comprising a drainage plate in the bottom of the laundry washer; and a magnet-operated, spring-loaded trap door in the bottom of the laundry washer and with access to the dryer;

a laundry dryer mounted beneath the laundry washer, the laundry dryer comprising a magnet-operated, spring-loaded trap door on the bottom of the dryer;

a second load compartment mounted on top of the laundry washer, the second load compartment comprising a hinged, spring-loaded trap door on top of the second load compartment; and a magnet-operated, spring-loaded trap door in the bottom of the second load compartment and with access to the washer;

a conveyor belt, such that the conveyor belt deposits laundry on the hinged, spring-loaded trap door on top of the second load compartment;

at least one fill hole for detergent mounted on the second load compartment and leading to a container area with machine-controlled access to the washer; and at least one fill hole for softener mounted on the second load compartment leading to a container area with machine-controlled access to the washer;

a conveyor belt underneath the magnet-operated, spring-loaded trap door on the bottom of the dryer, such that the conveyor belt moves the laundry to a desired location; and controls.

18. The combined laundry washer and dryer system of claim 17, wherein the combined laundry washer and dryer system further comprises a side-mounted closet, such that the side-mounted closet steams laundry placed inside it, the side-mounted closet comprising at least one hot air vent that extends from the dryer of the combined washer and dryer system into the side-mounted closet; and a door.

* * * * *